United States Patent [19]

Kelly et al.

[11] Patent Number: 5,071,036

[45] Date of Patent: Dec. 10, 1991

[54] EXTRUSION AID

[76] Inventors: Hartleigh Kelly, 3 Weewanda Street; Bruce A. Kelly, 36 North Esplanade, both of Glenelg North, South Australia, Australia

[21] Appl. No.: 560,173

[22] Filed: Jul. 31, 1990

[30] Foreign Application Priority Data

Aug. 3, 1989 [AU] Australia ..... PJ5586
Feb. 8, 1990 [AU] Australia ..... PJ8488

[51] Int. Cl.[5] ..... B65D 35/28
[52] U.S. Cl. ..... 222/103; 222/95
[58] Field of Search ..... 222/92, 95, 103, 214, 222/191, 192; 24/570

[56] References Cited

U.S. PATENT DOCUMENTS

| | | | |
|---|---|---|---|
| 2,023,763 | 12/1935 | Hinz | 222/95 |
| 3,248,012 | 5/1966 | Adams | 222/95 |
| 4,159,787 | 7/1979 | Wright | 222/103 |
| 4,574,983 | 3/1986 | Fatkin | 222/95 X |
| 4,778,082 | 10/1988 | Vitelle | 222/103 X |
| 4,928,851 | 5/1990 | Eatherly | 222/103 |
| 4,976,380 | 12/1990 | von Schuckmann | 222/103 |

FOREIGN PATENT DOCUMENTS

| | | | |
|---|---|---|---|
| 1091757 | 4/1955 | France | 222/95 |
| 1482872 | 4/1967 | France | 222/95 |
| 485870 | 10/1953 | Italy | 222/92 |
| 506861 | 12/1954 | Italy | 222/103 |
| 293336 | 9/1953 | Sweden | 222/103 |

*Primary Examiner*—Michael S. Huppert
*Assistant Examiner*—Anthoula Pomrening
*Attorney, Agent, or Firm*—Webb, Burden, Ziesenheim & Webb

[57] ABSTRACT

In this invention an extrusion aid comprises a strip of material which is desirably a low friction material such as a polymer, but nevertheless sufficiently rigid to deform the flexible wall of a tube containing paste or fluid contents, and the strip is provided with an elongate slot which is wider at its ends than intermediate its ends, and may terminate in part-circular walls. If the part-circular walls are spaced apart to accommodate the edges of a tube after extrusion takes place, the extrusion aid will be less likely to grip those edges and furthermore the aid will be easily positioned over the tube.

5 Claims, 1 Drawing Sheet

EXTRUSION AID

This invention relates to an extrusion aid which is useful for assisting in the extrusion of materials such as paste from within a tube.

BACKGROUND OF THE INVENTION

A great deal of wastage is known to occur due to incomplete extrusion of paste from a tube of deformable material, for example toothpaste, and wastage also occurs when the material within the tube is of a more fluent form, for example certain cosmetics, sunscreen material and the like. One of the reasons for this is the tendency of the material to adhere to the inner surface of the flexible wall tube, and in some instances to flow back into an area from which it has already been extruded.

The main object of this invention is to provide an extrusion aid which will efficiently assist in the expulsion of such material, yet which will be so simple in design that it will be of very low cost.

BRIEF SUMMARY OF THE INVENTION

In this invention an extrusion aid comprises a strip of material which is desirably a low friction material such as a polymer, but nevertheless sufficiently rigid to deform the flexible wall of a tube containing paste or fluid contents, and the strip is provided with an elongate slot which is wider at its ends and between its ends, and may terminate in part-circular walls. If the part-circular walls are spaced apart to accommodate the edges of a tube after extrusion takes place, the extrusion aid will be less likely to grip those edges and furthermore the aid will be easily positioned over the tube. In some instances the slot can extend beyond the part-circular portions thereof to facilitate sliding the aid over the tube, and can for example extend into a tab which can extend from a generally planar portion of the aid at an angle, which makes the device extremely easy to use, particularly when the tube is folded or otherwise of irregular shape.

BRIEF SUMMARY OF THE DRAWINGS

Embodiments of the invention are described hereunder in some detail with reference to and are illustrated in the accompanying drawings in which.

Figure 1:
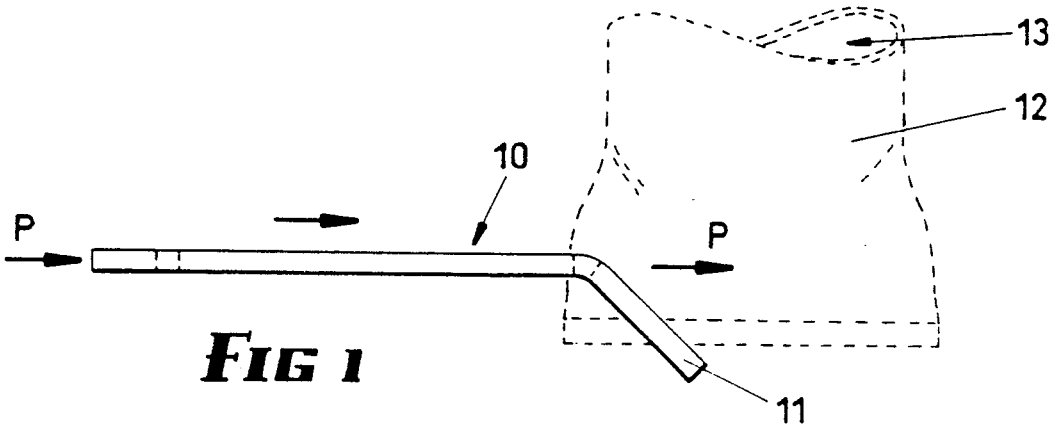
FIG. 1 is a plan view of an extrusion aid according to a first embodiment.
Figure 2:
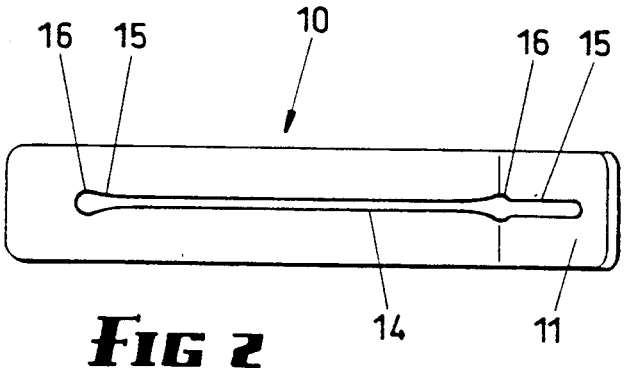
FIG. 2 is a front elevation of FIG 1.
Figure 3:
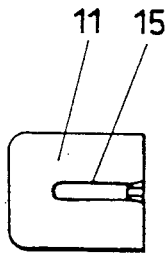
FIG. 3 is an end elevation of FIG. 2.

In the first embodiment, an extrusion aid 10 is formed from a polymeric material but preferably not having a low coefficient of friction, polythene being particularly suitable although other materials of similar friction of characteristics may be used. The extrusion aid 10 is a strip which has most of its length lying generally in the plane P—P, but which terminates in an outstanding tab 11 which extends outside of the plane P—P, in this embodiment at an angle of about 45° although that angle is not critical. However as best seen in FIG. 1, that angle facilitates movement of the extrusion aid 10 over the tail end of a tube 12 containing a paste like product 13.

Many tubes, when their contents are extruded, have two side walls which lie contiguous with one another but these side walls curve at the edges so as to increase the effective thickness of the tube but only at the edges. Extrusion aid 10 is provided with a slot 14 which is wider at its ends 15 than intermediate its ends, and in the illustrated embodiments the wider portion extends into the tab 11. This is very desirable because it facilitates assembly of the aid to the tube, it being otherwise difficult to attach the aid to the tube because of the need to have the slot sufficiently narrow for the slot walls to exert pressure on the tube. Further, the wider slot portion can accommodate a folded tube end. To accommodate the curved edges, the slot is provided with a pair of part-circular walls 16 at or near the ends, and the part-circular walls 16 have the increased width ends 15 merging into them.

Figure 4:
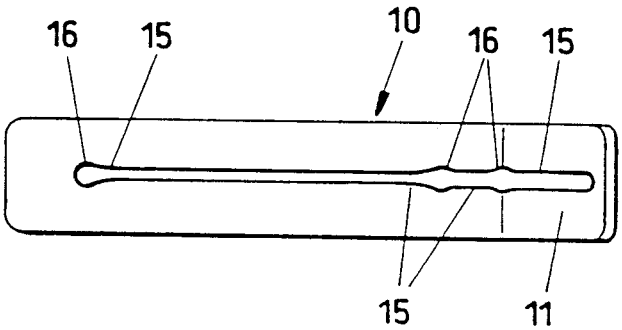
FIG. 4 is a view corresponding to FIG. 2 but of a second embodiment in which the aid is provided with three part-circular wall portions so that the aid can accommodate tubes of different sizes.

The second embodiment of FIG. 4 is substantially the same as the first embodiment excepting that there are provided three part-circular slot portions 16 so that the aid 10 can be used on tubes of differing sizes, and indeed more than three part-circular wall portions can be used as required for the aid to be useable on further different size tubes.

In use, the wider slot portion 15 in the tab 11 is moved across the tail of the tube 12 as illustrated in FIG. 1 until the ends of the tail are aligned with the part-circular walls 16, whereupon the extrusion aid can be worked up the tube 12 when it is required to extrude some of the product 13 therefrom. The aid is of such low cost that it may be discarded along with the empty tube after use.

The claims defining the Invention are as follows:

1. An extrusion aid useful for assisting in the extrusion of paste from a tube having a flexible wall, comprising a strip of material sufficiently rigid to deform a flexible wall of a tube for extrusion of paste therefrom, an elongate slot having two ends and extending through the strip for most but not all of the strip length, the slot having portions being wider at its ends than intermediate its ends, and being defined by walls which are spaced apart from each other and which diverge from one another towards the slot ends, said strip being generally planar for most of its length but terminating at one end in an extension tab which lies outside the general plane of the strip and which accommodates one of the slot ends.

2. An extrusion aid according to claim 1 wherein said slot extends into said extension tab and is of greater width in the tab than in the intermediate portion of the strip.

3. An extrusion aid according to claim 1 wherein part of each wider portion of said slot is defined party by part-circular walls.

4. An extrusion aid according to claim 1 wherein at least one wider portion of said slot is defined by merging the diverging slot walls with a part-circular wall at the end of the slot.

5. An extrusion aid according to claim 1 wherein said strip material is a semi-rigid polymer.

* * * ** *

UNITED STATES PATENT AND TRADEMARK OFFICE

CERTIFICATE OF CORRECTION

PATENT NO. : 5,071,036

DATED : December 10, 1991

INVENTOR(S) : Hartleigh Kelly and Bruce A. Kelly

It is certified that error appears in the above-identified patent and that said Letters Patent is hereby corrected as shown below:

On the title page:

Item [76]: under Inventors information, first inventor is from "Glenelg South".

Column 1 Line 58 "polythene" should read --polyethylene--.

Claim 3 Line 57 Column 2 "party" should read --partly--.

Signed and Sealed this

Twenty-seventh Day of April, 1993

*Attest:*

*Attesting Officer*

MICHAEL K. KIRK

*Acting Commissioner of Patents and Trademarks*